United States Patent [19]

Winters et al.

[11] Patent Number: 4,948,925

[45] Date of Patent: Aug. 14, 1990

[54] APPARATUS AND METHOD FOR ROTATIONALLY ORIENTING A FLUID CONDUCTING CONDUIT

[75] Inventors: Warren Winters; Michael B. Burton, both of Tulsa; Tommy M. Warren, Coweta; J. Ford Brett, Tulsa, all of Okla.

[73] Assignee: Amoco Corporation, Chicago, Ill.

[21] Appl. No.: 443,762

[22] Filed: Nov. 30, 1989

[51] Int. Cl.[5] ..... E21B 7/06; E21B 21/08; E21B 21/10; E21B 47/06

[52] U.S. Cl. ..... 175/48; 166/113; 175/61; 175/317; 175/325

[58] Field of Search ..... 175/317, 318, 324, 61, 175/73, 40, 48, 325; 166/330, 331, 113, 250; 33/306; 251/251, 145

[56] References Cited

U.S. PATENT DOCUMENTS

| | | | |
|---|---|---|---|
| 2,167,194 | 7/1939 | Anderson | 175/317 X |
| 2,675,874 | 4/1954 | Springer | 166/330 X |
| 3,152,646 | 10/1964 | Burns | 251/145 X |
| 3,352,370 | 11/1967 | Livingston | 175/325 |
| 4,628,495 | 12/1986 | Peppers et al. | 175/40 X |
| 4,699,224 | 10/1987 | Burton | 175/61 |
| 4,768,598 | 9/1988 | Reinhardt | 175/48 X |

*Primary Examiner*—Stephen J. Novosad
*Attorney, Agent, or Firm*—Scott H. Brown; Fred E. Hook

[57] ABSTRACT

Apparatus and method for orienting a collar on a fluid conducting conduit, such as a drill string, includes an orifice through the wall of the conduit and a latch assembly for latching the collar to the conduit. The latch assembly allows fluid communication through the orifice and rotates the collar when the conduit is rotated in a first direction about the longitudinal axis of the conduit. The latch assembly unlatches the collar from the conduit, prevents fluid communication through the orifice, and allows the conduit to rotate relative to the collar when the conduit is rotated ion a second, opposite direction. Also included are apparatus and method for rotationally orienting a fluid conducting conduit including an insert connectable inside the conduit so that the insert is rotatable with the conduit; a flow passageway extending through the insert; a pilot passageway extending through the insert; a piston bore in the insert; a piston, reciprocably mounted in the piston bore, for reciprocating between the ends of the piston bore, the piston restricting flow through the flow passageway and creating a fluid pressure increase on the upstream side of the insert when the piston is in a restricted position in the piston bore; and a barrier mass for blocking the pilot passageway in a selected rotational position of the pilot passageway and conduit in order to increase the fluid pressure at the downstream end of the piston bore and move the piston to the restricted position in the piston bore.

34 Claims, 5 Drawing Sheets

APPARATUS AND METHOD FOR ROTATIONALLY ORIENTING A FLUID CONDUCTING CONDUIT

BACKGROUND OF THE INVENTION

1. Field of the Invention

This invention relates to method and apparatus for rotationally orienting a fluid conducting conduit. More specifically, the invention relates to orienting and steering a subterranean drilling assembly such as used in drilling an oil or gas well.

2. Setting of the Invention

In order to enhance the recovery of subterranean fluids, such as oil and gas, it is sometimes desirable to orient the direction of the wellbore or borehole. For example, in an oil producing formation or strata which has little vertical depth and relatively greater horizontal extent with respect to the surface of the earth, a wellbore which extends horizontally through the oil producing zone may be more productive than one extending vertically.

In order to drill a wellbore horizontally, or at any selected angle, it is necessary to be able to steer the drilling bit at the end of the fluid conducting conduit, known as the drill string. U.S. Pat. No. 4,699,224, issued to Burton, discloses such apparatus and method, and is incorporated herein by reference thereto.

U.S. Pat. No. 4,699,224 discloses a method of horizontal drilling using a flexible drill string connected by a flexible joint to a drill bit collar. The drill bit collar is equipped with a stabilizer and a rotary drill bit. An eccentric cylindrical collar is used which circumferentially mounts to the downhole end of the flexible drill string over the flexible joint connected to the drill bit collar. The flexible joint rotates with the drill string within the eccentric collar. The thicker wall at one side of the eccentric collar forces the flexible joint to the opposite side of the wellbore which causes the drill bit to pivot about the flexible joint in the opposite direction of the deflection created by the eccentric collar. A borehole engaging means is mounted on the outside surface of the thicker wall of the eccentric collar.

The borehole engaging means, commonly called a "razorback" is used to rotationally orient the eccentric collar, i.e., the razorback engages the side of the borehole when the drill string is rotated in one direction and locks the eccentric collar to the wellbore thus rotationally orienting the eccentric collar with respect to the borehole. When the drill string is rotated in the opposite direction, the razorback disengages from the wellbore and a spring-biased latch mechanism latches the eccentric collar to the drill string and causes the eccentric collar to rotate with the drill string. This allows the eccentric collar to be rotationally reoriented with respect to the wellbore.

Although the borehole engaging means, or razorback, is designed to prevent the cylindrical eccentric collar from rotating with the drill string during drilling, friction between the eccentric collar and drill string together with downhole vibration and movement occurring during drilling will tend to rotate the collar, thereby resulting in the need to reorient the eccentric collar periodically. Normally, the razorbacks are oriented to the high side of the wellbore, i.e., the side of the wellbore closest to the surface of the earth, in order to drill a vertically planar curve.

At least two problems arise in the downhole operation of the razorbacks. The first problem is orienting the razorback to the high side of the wellbore (or any other selected side of the wellbore) while in the nondrilling mode, i.e., while rotating the drill string in the reverse direction. The second problem is maintaining orientation of the razorback and eccentric collar while drilling.

The first problem occurs during the reorientation of the razorback. The reorientation procedure consists of periodically raising the drilling assembly off the bottom of the wellbore and rotating the drill string backwards, normally counterclockwise, less than or nearly one full turn to a selected rotational orientation. At some point during this reverse rotation, a pawl or latch is supposed to engage the eccentric collar and cause the eccentric collar to be rotated with the drill string. Latch engagement has not been readily achieved in drilling tests because the latch spring breaks, the latch plugs with rock debris and drilling mud solids, etc.

The second problem of maintaining the razorback orientation during drilling arises because there has been no reliable method of sensing the rotational orientation of the razorback within the wellbore. U.S. Patent Application Ser. No. 07/281,293 attempts to provide a high side signal, i.e., a signal when the razorback is at the high side of the wellbore, by restricting flow through the drill string with a ball which is gravitationally rotated in a toroidal race. Flow through the drill string is divided between a primary flow port and a signal port. The ball is supposed to block the signal port when the signal port is on the lowest side of the wellbore and thereby increase the fluid pressure in the drill string upstream of the signal port. This increase in fluid pressure is a signal that the conduit, or drill string, and anything connected thereto is in a known rotational orientation. A problem with the apparatus and method of U.S. Patent Application Ser. No. 07/281,293, is that the ball gets stuck over the signal port due to hydraulic effects, i.e., the fluid flow through the drill string and signal port pulls the ball into the signal port.

Therefore, there is a need for an apparatus and method which will rotationally orient a fluid conducting conduit, such as a drill string, and also orient a collar, such as the eccentric collar, on the fluid conducting conduit. It is contemplated that such an apparatus and method will allow more accurate steering of subterranean drilling assemblies and result in higher production rates of oil and gas. It is also contemplated that such an apparatus and method will allow more accurate orientation of rotatable fluid conducting conduit and collars in virtually any environment.

SUMMARY OF THE INVENTION

The present invention is contemplated to overcome the foregoing deficiencies and meet the above described needs. For accomplishing this, the present invention provides a novel and improved apparatus and method for rotationally orienting a fluid conducting conduit, as well as a collar on a fluid conducting conduit.

The apparatus for orienting a collar on a fluid conducting conduit includes an orifice through the wall of the conduit and latch means for latching the collar to the conduit. The latch means allows fluid communication through the orifice and rotates the collar when the conduit is rotated in a first direction. The latch means unlatches the collar from the conduit, prevents fluid communication through the orifice, and allows the conduit to rotate relative to the collar when the conduit is rotated in a second direction opposite to the first direction.

The method of rotationally orienting a collar on a conduit with respect to the longitudinal axis of the conduit comprises: flowing pressurized fluid through the conduit; rotating the conduit in a first direction about the longitudinal axis of the conduit to rotate the collar; providing a collar signal when the collar is rotating with the conduit in a selected rotational orientation of the collar with respect to the conduit; and sensing the collar signal to determine when the collar is rotating with the conduit. The method of providing the collar signal may include changing the fluid pressure in the conduit, and preferably includes decreasing the fluid pressure in the conduit. The fluid pressure decreasing step includes providing an orifice through the wall of the conduit and flowing the pressurized fluid through the orifice when the collar is rotated with the conduit.

The apparatus for rotationally orienting a fluid conducting conduit, which may also be used to rotationally orient a collar on a fluid conducting conduit, includes an insert, a flow passageway, a pilot passageway, a piston bore, a piston, and a barrier means. The insert is connected to the inside of the conduit so that the insert is rotatable with the conduit. The flow passageway extends through the insert for passing fluid through the insert. The pilot passageway extends through the insert for passing fluid through the insert. A piston bore is also located in the insert. A piston is reciprocably mounted in the piston bore for reciprocating between the upstream and downstream ends of the piston bore. The piston restricts flow through the flow passageway and creates a fluid pressure increase on the upstream side of the insert when the piston is in a restricted position in the piston bore. Preferably, the restricted position is at the upstream end of the piston bore. The barrier means blocks the pilot passageway when the pilot passageway and conduit are in a selected rotational position in order to increase the fluid pressure at the downstream end of the piston bore and thereby move the piston to the restricted position in the piston bore.

The method may also include providing an orientation signal when the conduit is in a selected rotational orientation and sensing the orientation signal to determine when the conduit is in the selected rotational orientation. Preferably, rotation of the conduit is continued in the first direction after sensing the collar signal until the orientation signal is sensed in order to determine when the conduit is in the selected rotational orientation and the collar is in the selected rotational orientation. The orientation signal is provided by changing the fluid pressure in the conduit and, preferably, by increasing the fluid pressure in the conduit. After the orientation signal is sensed, the conduit is rotated in a second direction, opposite to the first direction, in order to rotate the conduit relative to the collar which leaves the collar in the selected rotational orientation with respect to the longitudinal axis of the conduit.

BRIEF DESCRIPTION OF THE DRAWINGS

The present invention will be better understood by reference to the examples of the following drawings.

DETAILED DESCRIPTION OF THE PREFERRED EMBODIMENTS

FIGS. 1–9 present embodiments of the apparatus and method, generally designated 20, for rotationally orienting a fluid conducting conduit 22. As exemplified in FIG. 1, in the preferred embodiment, the method and apparatus 20 is used for orienting the drill string, also designated 22, of an oil or gas well, although it is intended to be understood that the method and apparatus 20 may be used to orient virtually any type of rotatable conduit in virtually any type of environment, e.g., water wells, steam wells, underwater conduit or pipe, etc.

Figure 1:
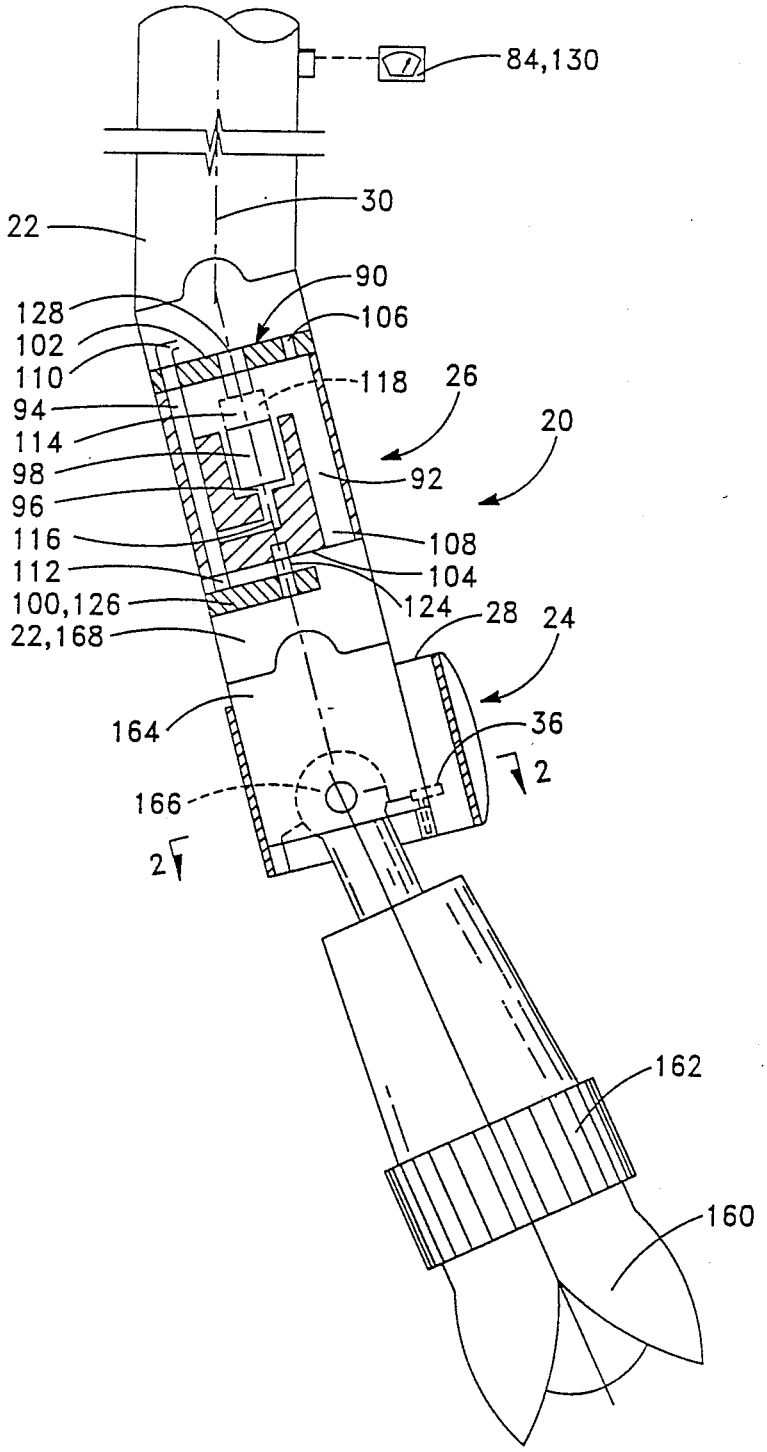
FIG. 1 is a partially sectioned side view of an embodiment of the apparatus and method for rotationally orienting a fluid conducting conduit of the present invention.

Referring to the example of FIG. 1, the apparatus 20 of the present invention may b generally described as comprising a collar orienting apparatus 24 and a conduit orienting apparatus 26. The collar orienting apparatus 24 and the conduit orienting apparatus 26 may be used independently of or in combination with one another and the other features of the present invention. Preferably, they are used in combination with one or more features of the present invention in order to enhance such features.

Referring to the example of FIG. 1, the collar orienting apparatus 24 is used for orienting a collar 28 on a fluid conducting conduit 22. Referring to example FIG. 2, the collar 28 and conduit 22 are rotatable relative to one another about the longitudinal axis 30 of the conduit 22. The collar orienting apparatus 24 may be described as generally comprising an orifice 32 through the wall 34 of the conduit 22 and a latch means, generally designated 36. The latch means 36 is used for latching the collar 28 to the conduit 22, allowing fluid communication through the orifice 32, and rotating the collar 28 when the conduit 22 is rotated in a first direction ("orienting") about the longitudinal axis 30 of the conduit 22. Conversely, the latch means 36 is used for unlatching the collar 28 from the conduit 22, preventing fluid communication through the orifice 32, and allowing the conduit 22 to rotate relative to the collar 28 when the conduit 22 is rotated in a second direction ("drilling") about the longitudinal axis of the conduit 22, the second direction being opposite the first direction.

The collar orienting apparatus 24 is normally coaxially and rotatably mounted on the outside surface 42 of conduit 22 with the fluid flowing within the inside surfaces 44 of the conduit 22. The collar 28 has an outside surface 46 and an inside surface 48. In the preferred embodiment, the collar 28 is an eccentric collar 28, i.e., the collar 28 is a cylindrical sleeve with a cylindrical hole passing longitudinally therethrough and the axis of the hole is intentionally displaced to one side of the central axis of the collar. The resulting offset creates a relatively thick wall 50 on one side of the collar and a relatively thin wall 52 on the other side of the collar. Typically, the razorback or borehole engaging means 54 is mounted on the outside surface 46 of the thick wall 50 of the collar and the latch means 36 latches to the inside surface 48 of the collar 28 on the other side of the thick wall 50. Such an eccentric collar and its use, without the improvements of the present invention, is described in U.S. Patent No. 4,699,224 which is incorporated herein by reference thereto.

Figure 2:
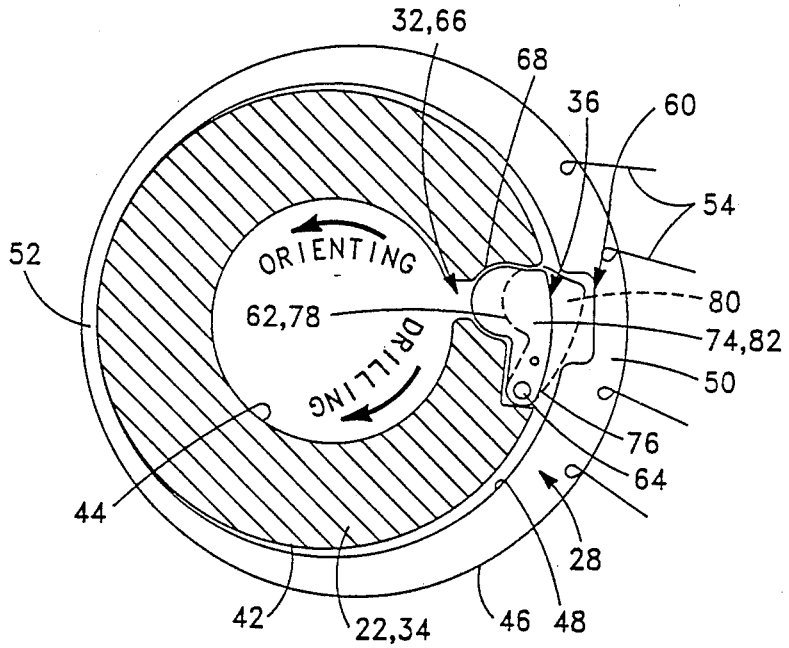
FIG 2 is a view taken along line 2—2 of FIG. 1.

Referring to the example of FIG. 2, in the preferred embodiment, the collar orienting apparatus 24 comprises a recess 60 in the inside surface 48 of the collar 28. Preferably, the recess 60 and the latch means 36 are radially coincident with respect to the longitudinal axis 30 of the conduit 22 at least once during a rotation of the conduit 22 relative to the collar 28. By radially coincident is meant that the recess 60 and the latch means 36 coincide on the same radius extending from the longitudinal axis 30, as illustrated in FIG. 2. In the prototype apparatus 20, the latch means 36 and recess 60 rotate in the same radial plane with respect to the longitudinal axis 30.

As exemplified in FIG. 2, preferably the latch means 36 comprises a valve 62 connected to the orifice 32 for sealing the orifice 32 when the orifice 32 and the recess 60 are not radially coincident, i.e., the valve 62 seats in the orifice 32 and blocks it when the valve and recess are not radially coincident. Biasing means 64 bias the valve 62 into latching engagement with the recess 60 when the valve 62 and the recess 60 are radially coincident.

In the preferred embodiment, as exemplified in FIG. 2, when the valve 62 is radially coincident with the recess 60, the orifice 32 is also radially coincident with the recess 60. Therefore, the biasing means 64, which is a spring 64 in the preferred embodiment, simply forces the valve 62 into the recess 60. When the orifice 32 and valve 62 are not radially coincident with the recess 60, the inside surface 48 of the collar 28 forces the valve 62 into the orifice 32 and blocks or effectively seals the orifice 32.

The fluid pressure inside the conduit 22 also serves to bias the valve 62 into engagement with the recess 60 when the valve 62, orifice 32, and recess 60 are radially coincident. The fluid communication through the orifice 32 when the valve 62 is biased into the recess 60 also biases the valve 62 into engagement with the recess 60 and purges the orifice 32 and valve 62 keeping the orifice 32 and valve 62 free of debris, such as drilling mud and drilling fragments, which might otherwise render the latch means 36 inoperable.

In the prototype collar orienting apparatus 24, the orifice 32 includes a first end 66 extending through the inside surface 44 of the conduit wall 34 and a second end 68 extending through the outside surface 42 of the conduit wall 34. The second end 68 forms a valve seat, also designated 68. Also in the prototype, the latch means 36 comprises a latch arm 74. The latch arm includes a first end 76 pivotably connected to the conduit wall 34 adjacent the second end 68 of the orifice 32 and a second end 78 extending about perpendicularly to the first end 76. The second end 78 forms the valve 62. The pivotable axis of the first end 76 should be about parallel to the longitudinal axis 30 of conduit 22. The latch arm 74 is pivotable between an open position 80 in which the second end 78 extends outside of the conduit wall 34 and the orifice 32 is open and a closed position 82 in which the second end 78 and valve 62 close the orifice 32. The biasing means 64 biases the latch arm 74 into the open position 80.

In the prototype collar orienting apparatus 24, the biasing means 64 biases the second end 78 of the latch arm 74 into the open position 80 and into engagement with the recess 60 when the recess 60 and the second end 68 of the orifice 32 are radially coincident. The second end 78 of the latch arm 74 latches into the recess 60 when the conduit 22 is rotated in one direction (counterclockwise in FIG. 2) in order to rotate the collar 28 with the conduit 22. The second end 78 of the latch arm 74 is unlatched from the recess 60 and is moved to the closed position 82 by the inside surface 48 of the collar 28 when the conduit 22 is rotated the other direction (clockwise in FIG. 2). Referring to the example of FIG. 1, in the preferred embodiment, the collar orienting apparatus 24 includes sensing means 84 for sensing fluid loss through the orifice 32 in order to determine when the collar 28 is latched to the conduit 22. The sensing means 84 may be a pressure sensing device or similar device for sensing fluid loss. In the prototype apparatus 24, the sensing means 84 senses fluid pressure changes in the conduit 22 and is therefore a pressure sensing device, such as a pressure gauge or pressure transmitter which will transmit a signal indicative of fluid pressure in the conduit 22 to a remote location.

As previously mentioned, when the orifice 32 and latch arm 74 are positioned radially coincident with the recess 60, as illustrated in FIG. 2, the spring 64, which is typically a torsional spring, causes the latch arm 74 to pivot outward until the latch arm 74 fully engages the recess 60. In addition to the mechanical force applied by the spring 64, the hydraulic force of the fluid pressure from the inside of the conduit 22 tends to force the valve 62 out of the valve seat 68. For example, given an approximate valve 62 diameter of one-half inch, a one hundred psi pressure differential between the inside and the outside of the conduit 22 produces a twenty pound force applied to the valve 62. Therefore, if the spring 64 fails or the latch movement is impeded by an accumulation of rock debris or mud solids in the vicinity of the recess 60, the hydraulic force helps to assure continued operational reliability of the latching means 36. Further, when the valve 62 is opened, the fluid is ported from the inside of the conduit 22 into the annular space between the conduit 22 and the collar 28 and the fluid acts to flush accumulated debris from the vicinity of the latch means 36 further reducing the likelihood of a mechanical latch failure.

An important function of the latch arm 74 and valve 62 is to create a detectable fluid pressure decrease inside the conduit when the valve 62 opens. This fluid pressure decrease can be detected at the surface to signal that the latch means 36 is engaged in the recess 60 which also indicates that the collar 28 is latched to the conduit and can be rotationally oriented by rotating the conduit 22. The diameter of the orifice 32 can be sized within a range of practical limits to control the magnitude of the fluid pressure decrease when the valve 62 and latch arm 74 are biased to the open position 80. For example, when the device is used with a well drilling apparatus, if the drill bit flow orifices (not illustrated) are sized to produce a one hundred psi (pounds per square inch) pressure drop at a flow rate of eighty gallons per minute, when the valve 62 is open about twenty-seven gallons per minute will flow through a three-eighths inch diameter orifice 32 and fifty-three gallons per minute will flow through the drill bit. This will result in a fifty-five psi drop in fluid pressure at the surface and at the pump discharge (i.e., the pump pumping the fluid through the conduit).

Although the valve 62 exemplified in FIG. 2 is generally spherical in shape, other shapes, such as frustoconical, may be used to enhance the hydraulic effects on the valve 62.

Figure 2A:
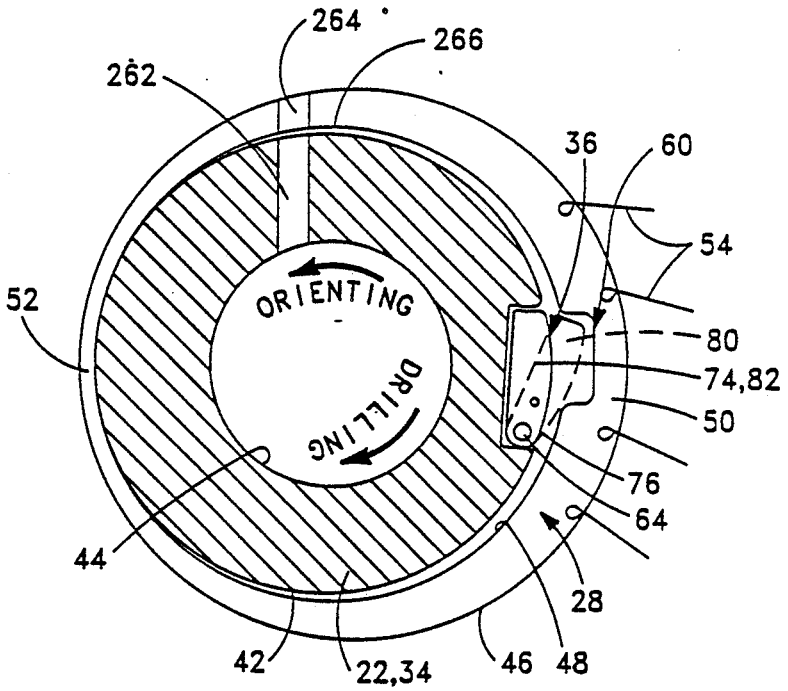
FIG. 2A is a view of an alternate embodiment of that shown in FIG. 2.

An alternate embodiment of the collar orienting apparatus is shown in FIG. 2A. In this embodiment the latch function and fluid flow control function are separated. The latch means 36 operates the same as in the preferred embodiment, but there is no orifice in proximity to the latch. Flow port 262 in conducting conduit 22 and flow port 264 in collar 28 are positioned both axially and radially so that they are aligned to form a continuous flow conduit when latch 36 is engaged in recess 60. Flow ports 262 and 264 may be lined with a hardened insert, such as tungsten carbide, to prevent erosion. The clearance between collar 28 and conduit 22, designated 266 in FIG. 2A, is sufficiently small to prevent fluid communication between flow ports 262 and 264 unless latch 36 is engaged in recess 60.

Referring to the example of FIG. 1, a previously mentioned, the apparatus 20 also includes a conduit orienting apparatus 26. The conduit orienting apparatus is used for rotationally orienting a fluid conducting conduit 22. The conduit 22 is rotatable about its longitudinal axis 30. Referring to the example of FIGS. 1, 3, 4, and 5, the conduit orienting apparatus 26 may be generally described as comprising an insert 90, a flow passageway 92, a pilot passageway 94, a piston bore 96, a piston 98, and barrier means 100.

The insert 90 is connectable inside the conduit 22 so that the insert 90 is rotatable with the conduit 22. The insert 90 restricts fluid flow through the conduit 22. The insert has an upstream side 102 facing into the fluid flow through the conduit 22 and a downstream side 104 facing the opposite direction The flow passageway 92 extends through the insert 90 for passing fluid through the insert 90. The flow passageway has an upstream end 106 and a downstream end 108. The upstream end 106 extends through the upstream side 102 of insert 90 and the downstream end 108 extends through the downstream side 104 of insert 90.

The pilot passageway 94 extends through the insert 90 for passing fluid through the insert 90. The pilot passageway 94 has an upstream end 110 and a downstream end 112. The upstream end 110 extends through the upstream side 102 of the insert 90 and the downstream end 112 extends through the downstream side 104 of the insert 90.

Piston bore 96 is located in the insert 90 and has an upstream end 114 and a downstream end 116. The upstream end 114 is fluid communicatingly open to the flow passageway 92 and the downstream end 116 is fluid communicatingly open to the pilot passageway 94. The piston 98 is reciprocably mounted in the piston bore 114 for reciprocating between the upstream and downstream ends 114, 116 of the piston bore 96. The piston 98 restricts flow through the flow passageway 128 and creates a fluid pressure increase on the upstream side of the insert 90 when the piston 98 is in a restricted position 118 of the piston bore 96.

The barrier means 100 is used for blocking the pilot passageway 94 in a selected rotational position of the pilot passageway 94 and conduit 22 in order to increase the fluid pressure at the downstream end 116 of the piston bore 96 and move the piston 98 to the restricted position 118 in the piston bore 96.

In the prototype conduit orienting apparatus 26, the barrier means blocks the downstream end of the pilot passageway 94, as exemplified in FIGS. 1, 3, 4, and 5. The prototype barrier means 100 includes a shaft 124 extending axially from the downstream side 104 of the insert 90 and a semicircular barrier mass 126 rotatably mounted on the shaft 124 (best seen in FIG. 5). The downstream end 112 of the flow passageway 92 is eccentrically positioned with respect to the longitudinal axis 30 of the conduit 22 so that the barrier mass 126 may rotate to block the downstream end 112 of the pilot passageway 94. In the prototype apparatus 26, the downstream end 112 of the pilot passageway 94 extends beyond the downstream side 104 of insert 90 and the barrier mass 126 is spaced away from the downstream side 104 of the insert 90 so that the barrier mass 126 does not block the downstream end 108 of the flow passageway 92. The eccentric positioning of the pilot passageway downstream end 112 with respect to the longitudinal axis of the conduit 22 allows the pilot passageway 94 to be selectably positioned within the conduit 22 so that when the pilot passageway downstream end 112 is blocked and the piston 98 is shifted within the piston bore 96 the rotational orientation of the conduit 22 is defined. The pilot passageway 94, particularly the downstream end 112 of the pilot passageway 94, and the shape of the barrier mass 126 may be selected to achieve blockage of the pilot passageway 94 in a desired rotational orientation of the pilot passageway 94.

In the prototype conduit orienting apparatus 26, the flow passageway 92 includes a control port 128 extending through the upstream side 102 of the insert 90. The control port 128 should be open to fluid communication with the flow passageway 92 when the pilot passageway 94 is open, i.e., not blocked by the barrier mass 126, and the piston 98 is at the downstream end 116 of the piston bore 114. The control port 128 should be closed to fluid communication with the flow passageway 92 when the pilot passageway is blocked by the barrier means 100 and the piston is in the restricted position 118. In the prototype apparatus 26, the restricted position 118 of the piston 98 is at the upstream end 114 of the piston bore 96.

Referring to FIG. 1, in the preferred embodiment, the conduit orienting apparatus 26 includes sensing means 130 for sensing shifts of the piston 98 in the piston bore 96. In the prototype apparatus 26, the sensing means 130 is the same sensing means 84 used with the collar orienting apparatus 24 discussed above. As the sensing means 84, the sensing means 130 may sense changes in fluid flow through the conduit in order to determine when the piston 98 is in the restricted position 118. Preferably, the sensing means 130 senses fluid pressure changes in the conduit 22 upstream of the insert 90 in order to determine when the pilot passageway 94 and conduit 22 are in the selected rotational position. More preferably, the sensing means 130 senses fluid pressure increases due to the piston 98 restricting flow through the flow passageway 92, and may be a pressure gauge or pressure transmitting device.

The latch means 36 should latch the collar 28 to the conduit 22 in a selected rotational orientation of the collar 28 relative to the pilot passageway 94. In other words, when the conduit orienting apparatus 26 is installed in conduit 22, the pilot passageway 94 should be placed in a known or selected rotational orientation relative to the latch means 36 if the conduit orienting apparatus 26 is to be used with the collar orienting apparatus 24. This is necessary since the latch means 36 determines the rotational orientation of the collar 28, i.e., the latch means 36 latches to the collar 28 and rotates the collar 28 with the conduit 22. Preferably, the latch means 36 latches the collar 28 to the conduit 22 when a selected point on the collar 28 is diametrically opposite the pilot passageway 94. In the prototype apparatus 20, the latch means 36 is diametrically opposite the pilot passageway 94 when the latch means 36 latches to the collar 28.

As illustrated in FIG. 1, the prototype conduit orienting apparatus 26 is mounted in a section of conduit 22 which may then be connected into a string of conduit sections, such as a drill string.

In operation of the conduit orienting apparatus 26, the conduit 22 containing the conduit orienting apparatus 26 is rotated until the sensing means 130 indicates a shift of the piston 98 to the restricted position 118 (normally indicated by a pressure increase in the conduit 22 upstream of the insert 90). The sensing means 130 will give such an indication regardless of the direction of rotation of the conduit 22, although when the conduit orienting apparatus 26 is used with the collar orienting apparatus 24, the direction of rotation of the conduit 22 should be the same as that used to activate the collar orienting apparatus 24, as further discussed below. Since the barrier means 100 is gravitationally operated, the prototype conduit orienting apparatus 26 is designed so that the barrier means 100 blocks the downstream end 112 of the pilot passageway 94 when the pilot passageway is at the lowest side of the insert 90 with respect to the surface of the earth, i.e., at the lowest rotational orientation in the borehole.

Figure 3:
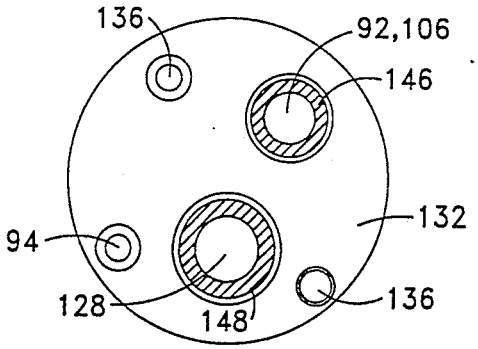
FIG. 3 is a view taken along line 3—3 of FIG. 4.
Figure 4:
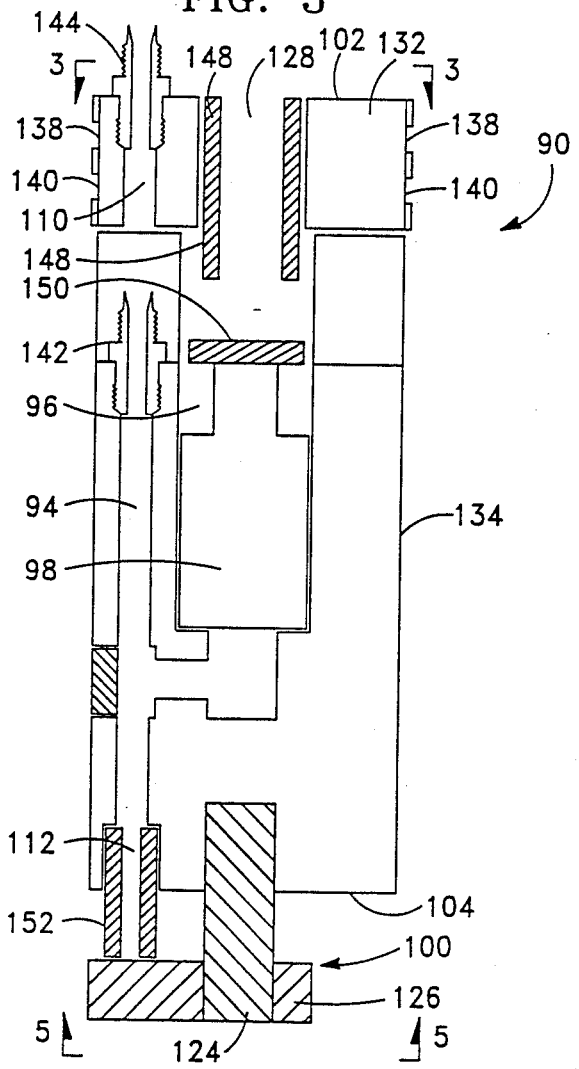
FIG. 4 is a sectional side view, partially exploded, of an embodiment of the conduit orienting apparatus of the present invention.

Referring to the example of FIGS. 3 and 4, in the prototype insert, orifice plate 132 forms the upstream side 102 of the insert 90. The orifice plate 132 is bolted, or similarly attached, to the pilot block 134 with bolts extending through bolt holes 136, best seen in FIG. 3. Set screw groove 138 is provided in the side of the orifice plate 132 in order to lock or secure the insert 90 in a selected rotational orientation within the conduit 22. 0-ring groove 140 extends circumferentially around the orifice plate 132 for sealing the insert 90 in the conduit, i.e., preventing fluid passage around the outside circumference of the insert 90. The conduit section 22 within which the insert 90 is located should be provided with a shoulder and/or grooves (not illustrated) for retaining rings and washers, or equivalent fastening should be provided, so that the insert 90 can be axially secured within the conduit or drill string 22. The set screws and set screw groove 138 may be replaced with equivalent locking devices to lock the insert 90 in a selected rotational orientation within the conduit section 22.

Flow passageway 92, pilot passageway 94, and control port 128 extend through the orifice plate 132 into the pilot block 134. A swagelok fitting 142 or similar sealing device is used to seal the connection of the pilot passageway 94 between the orifice plate 132 and the pilot block 134 because of the high fluid pressures encountered in the pilot passageway. A swagelok fitting 144 or similar tubing fitting may be used at the upstream end 110 of the pilot passageway 94 to prevent debris from entering the pilot passageway.

The flow passageway 92 is lined with a carbide sleeve 146 to prevent erosion of the flow passageway 92. The control port 128 is similarly lined with a carbide sleeve 148 to prevent erosion of the control port and to provide a good seal with the piston 98. The carbide sleeve 148 extends beyond the downstream side of the orifice plate 132 to seal with the piston 98 which has a carbide disc 150 at its upstream end. The downstream end 112 of the pilot passageway 94 is lined with a carbide sleeve 152 to provide a good seal with the barrier means 100. The carbide sleeves 146, 148, 152 may also be used and selected to vary the size of the passageways 92, 94, 128 in order to control the magnitude of the pressure change when the pilot passageway 94 is blocked by the barrier means 100 and to control the volume of fluid flow through the insert 90.

The passageways 92, 94, 128 may be sized to give a desired upstream pressure increase when the barrier means 100 blocks the pilot passageway 94 and the piston is in the restricted position 118. FIGS. 6–9 present a schematic example of the operation and sizing of the insert 90 and passageways 92, 94, 128. The calculations for the example are based on the following parameters: a constant flow of sixty gallons per minute, i.e., the fluid pressure upstream of the insert 90 is varied to maintain a constant flow through the conduit 22 and insert 90; a fluid density of 8.35 pounds per gallon; and a nozzle discharge coefficient (Cd) of 0.8. These parameters give a pressure drop across the insert 90 equal to 3.9 divided by the total passageway area squared ($\Delta P = 3.9/A^2$). For purposes of calculation, the pilot passageway 94 is given a one-eighth inch diameter or area of 0.012 square inches. The control port 128 is given a diameter of fifteen thirty-seconds of an inch (0.173 square inch area). The upstream end 106 of the flow passageway 92 is given a diameter of fourteen thirty-seconds inch (0.150 square inch area). This gives a total orifice area through the insert 90 of 0.335 square inches when the pilot passageway 94 is open and 0.150 square inches when the pilot passageway 94 is closed by the barrier means 100. It should be noted that the portion of the flow passageway 92 extending through the pilot block 134 should be large enough to accommodate the flow from the upstream end 106 of the flow passageway 92 plus the flow through the control port 128 when the piston 98 is at the downstream end 116 of the piston bore 96.

Figure 6:
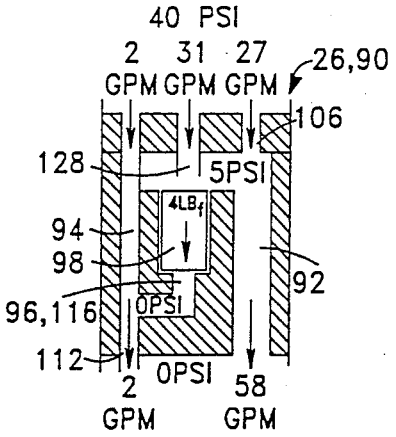
FIGS. 6–9 schematic representations of the operation of the conduit orienting apparatus of FIG. 4.

Referring to FIG. 6, the pilot passageway 94 is open and the piston 98 is at the downstream end 116 of piston bore 96. The fluid pressure upstream of the insert 90 is forty psi and downstream is zero psi. The pressure at the downstream end 116 of the piston bore 96 is also zero psi. The fluid flows through the pilot passageway 94, control port 128, and flow passageway 92 are two gallons per minute, thirty-one gallons per minute, and twenty-seven gallons per minute, respectively.

Figure 7:
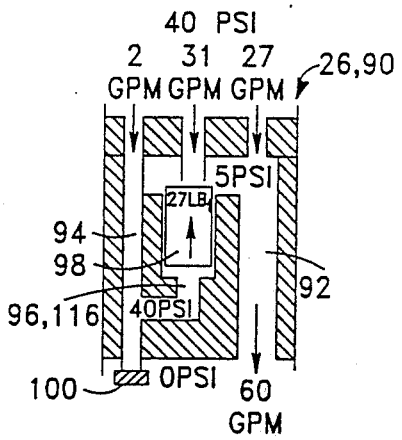

FIG. 7 illustrates the initial effect on the conduit orienting apparatus 24 when the barrier means 100 blocks the pilot passageway 94. It is seen that when the pilot passageway 94 is blocked by the barrier means 100, the pressures in the pilot passageway 94 and at the downstream end 116 of the piston bore 96 equalize with the pressure upstream of the insert 90 and therefore the same pressure present upstream of the insert 90 is present at the downstream end 116 of the piston bore 96 (forty psi).

Figure 8:
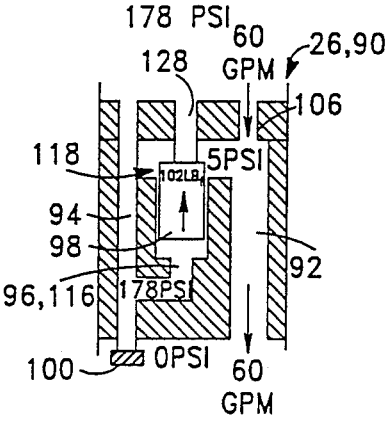

FIG. 8 illustrates the conduit orienting apparatus 26 after the piston 98 has shifted to the restricted position 118. The pressure upstream of the insert 90 has increased to one hundred seventy-eight psi in order to flow the required sixty gallons per minute through the flow passageway 92. The pressure at the downstream end 116 of the piston bore 96 has also increased to one hundred seventy-eight psi.

Figure 9:
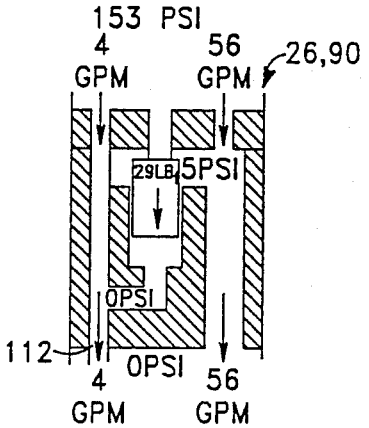
Figure 5:
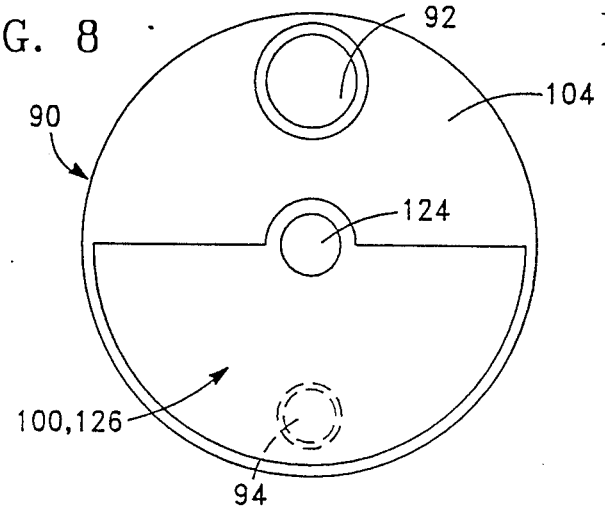
FIG. 5 is a view taken along line 5—5 of FIG. 4.

In FIG. 9, the conduit 22 has been rotated and the barrier means 100 has rotated away from the downstream end 112 of the pilot passageway 94 and therefore the piston 98 is beginning to shift towards the downstream en 116 of the pilot bore 96.

Referring to FIGS. 1 and 2, the method of rotationally orienting a collar 28 on a conduit 22 with respect to the longitudinal axis 30 of the conduit 22 includes: providing an orifice 32 through the wall 34 of the conduit 22; flowing pressurized fluid through the conduit 22 and orifice 32 and rotating the collar 28 with the conduit 22 when the conduit 22 is rotated in a first direction (normally counterclockwise) about the longitudinal axis 30 of the conduit 22; and preventing fluid flow through the orifice 32 and allowing the conduit 22 to rotate relative to the collar 28 when the conduit 22 is rotated in a second direction about the longitudinal axis 30 of the conduit 22. The second direction is opposite to the first direction around the longitudinal axis 30 of the conduit 22 (normally clockwise). The method further includes latching the collar 28 to the conduit 22 and passing fluid through the orifice 32 in a selected rotational orientation of the collar 28 with respect to the conduit 22. The method further includes sensing fluid loss through the orifice 32 to determine when the collar 28 is rotating with the conduit 22 and preferably includes sensing fluid pressure loss in the conduit 22 upstream of the orifice 32 to determine when the collar 28 is rotating with the conduit 22.

Referring to FIGS. 1, 3, 4, and 5, the method of rotationally orienting a conduit 22 with respect to the longitudinal axis 30 of the conduit 22 includes: placing an insert 90 containing a reciprocable piston 98 in the conduit 22 so that the insert 90 will rotate with the conduit 22; flowing pressurized fluid through the conduit 22 and insert 90 so that the fluid flows from the upstream side 102 of the insert 90 to the downstream side 104 of the insert 90; creating a fluid pressure increase inside the insert 90 in a selected rotational orientation of the insert 90 and conduit 22; using the fluid pressure increase inside the insert to shift the piston 98 to a restricted position 118 when the conduit 22 and insert 90 are in the selected rotational orientation; rotating the conduit 22 about the longitudinal axis 30 of the conduit 22; and sensing the shift of the piston 98 to the restricted position 118 to determine the rotational orientation of the conduit 22. In the preferred embodiment, the piston 98 restricts fluid flow through the conduit 22 and insert 90 when the piston is in the restricted position 118 and increases the fluid pressure in the conduit 22 on the upstream side 102 of the insert 90; and the fluid pressure is sensed in the conduit 22 on the upstream side 102 of the insert 90 in order to determine the rotational orientation of the conduit 22. Preferably, the fluid flow is restricted through the insert 90 with a gravitationally positioned barrier mass 126 o the downstream side 104 of the insert 90.

In a more preferred embodiment, the method of rotationally orienting a collar 28 on a conduit 22 with respect to the longitudinal axis 30 of the conduit includes: flowing pressurized fluid through the conduit 22; rotating the conduit 22 in a first direction about the longitudinal axis 30 of the conduit to rotate the collar 28; providing a collar signal when the collar 28 is rotating with the conduit 22 in a selected rotational orientation of the collar 28 with respect to the conduit 22; and sensing the collar signal to determine when the collar 28 is rotating with the conduit 22. Preferably, the collar signal is provided by changing the fluid pressure in the conduit and more preferably is provided by decreasing the fluid pressure in the conduit 22 and sensing the fluid pressure decrease. In the preferred embodiment, the fluid pressure is decreased by providing an orifice 32 through the wall 34 of the conduit 22 and flowing the pressurized fluid through the orifice 32 when the collar 28 is rotated with the conduit 22.

The more preferred method may also include providing an orientation signal when the conduit 22 is in a selected rotational orientation; and sensing the orientation signal to determine when the conduit 22 is in the selected rotational orientation. When used with the collar orienting method, the more preferred method includes continuing to rotate the conduit 22 in the first direction after sensing the collar signal; and sensing the orientation signal to determine when the conduit 22 is in the selected rotational orientation (and when the collar 28 is in the selected rotational orientation with respect to the conduit 22, since the collar's rotational orientation is referenced to the conduit 22 when the collar signal is present).

Preferably, the providing an orientation signal step includes changing the fluid pressure in the conduit. More preferably, the providing an orientation signal step includes increasing the fluid pressure in the conduit 22 and the sensing step includes sensing the fluid pressure increase.

In the more preferred method, once the fluid pressure increase of the orientation signal is sensed, the conduit 22 is rotated in a second direction, opposite to the first direction, to rotate the conduit 22 relative to the collar 28 and leave the collar in the selected rotational orientation, i.e., when the conduit is rotated in the second direction the conduit disengages from the collar and does not rotate the collar 28.

To further illustrate the operation of the apparatus and method 20, an example using an oil well drill string follows. Referring to the example of FIG. 1, the drill bit 160 and drill bit collar 162 are connected to the end section 164 of drill string 22 with a flexible joint 166, such as a knuckle joint or the ball and socket 166 illustrated. In the prototype apparatus 20, a knuckle joint 166 is used. A knuckle joint is a type of universal joint known to the art. The collar 28 is rotatably positioned on the end section 164 and the latching means 36 is placed in the wall 34 of the end section 164 so as to rotate within the collar 28, as previously described. End section 164 is connected to insert housing section 168. Normally, because of the tight radius drilling curves created with this type of apparatus, the joint between the insert housing section 168 and end section 164 should be a flexible joint, as is known in the art. The collar 28 should be positioned around or immediately above the knuckle joint 166 since the purpose of the eccentric collar 28 (when used with a drill string) is to deflect the drill bit by deflecting the knuckle joint 166. The conduit orienting apparatus 26 should be adjacent the collar orienting apparatus 24 to facilitate alignment, i.e., so the pilot passageway 94 can be properly rotationally oriented with respect to the latch means 36 and razorback 54, and to minimize the possibility of the drill string 22 twisting between the collar orienting apparatus 24 and conduit orienting apparatus 26.

For purposes of discussion, it will be assumed that it is desired to deflect the direction of drilling in a vertical plane, i.e., from generally vertical toward horizontal with respect to the earth's surface. To start the drill bit 160 at an angular direction with respect to the vertical borehole, the razorback 54 is first positioned to engage the borehole at a point corresponding to the inside radius of the desired borehole curvature. Consequently, the knuckle joint 166 is forced to the opposite side of the borehole which orients the drill bit 160 in the desired direction, as is explained in more detail in U.S. Pat. No. 4,699,224, which is incorporated herein by reference thereto. Since it is desired to steer the drilling operation toward horizontal in a vertical plane, it is desired to deflect the drill bit towards the surface of the earth and therefore the razorback 54 should engage the high side of the borehole. In the prototype apparatus, the recess 60 is on the inside surface of the thick wall 50 of the collar 28 opposite the razorback 54. The insert 90 is secured in the insert housing 148 so that the pilot passageway is diametrically opposite the orifice 32. Since the barrier means 100 is gravitationally oriented, the barrier mean 100 blocks the pilot passageway 94 when the pilot passageway is on the low side of the borehole. This gives a pressure increase upstream of the insert 90 when the orifice 32 is at the top or high side of the borehole. Therefore, in order to orient a drill string 22 and drill bit 160 using the collar orienting apparatus 24 and conduit orienting apparatus 26 of the present invention, the following procedure is used. Drilling activity, i.e., rotation of the drill bit in a clockwise direction is stopped and the drill bit 160 is raised slightly off the bottom of the borehole while continuing to pump fluid through the drill string 22. The drill string or conduit 22 is then slowly rotated counterclockwise until the fluid pressure (or pump output pressure) decreases due to the orifice 32 opening as the latch means 36 engages recess 60. This also indicates that the latch means 36 has engaged the eccentric collar 28, and can be used to determine the slippage during the previous drilling interval. Rotation of the drill string 22 counterclockwise continues until the pump pressure, i.e., the pressure in the conduit upstream of the insert 90, increases (due to the barrier mean 100 blocking the pilot passageway 94 in the insert 90) which signals that the razorback 54 is oriented to the high side of the borehole. Fluid flow through the drill string should then be momentarily reduced or halted to disengage the latch means 36 and reseat the valve 62 in orifice 32. The drill string 22 should then be slowly rotated clockwise to engage the razorback 54 with the borehole and to reset the conduit orienting apparatus 26 by gravitationally rotating the barrier means 100 away from the pilot passageway 94. When the fluid pressure in the drill string 22 drops, indicating the barrier means 100 has opened the pilot passageway 94, pumping at a full flow rate and drilling rotation in the clockwise direction can be resumed.

The collar orienting apparatus 24 also may serve as a razorback 54 or collar 28 orientation sensor. The point at which the valve 62 opens and causes fluid pressure decrease during the orientation procedure is indicative of the razorback 54 position prior to readjustment. A clear indication of whether and to what extent the razorback 54 has moved during drilling is thus provided. The valve 62 is in effect a form of measurement while drilling wherein the latch means 36 functions as the sensor which detects razorback orientation, the valve 62 serves as a pulsor, and the pressure gauge or pressure sensor which senses fluid pressure in the conduit 22 coupled with visual observation and interpretation of a reference mark on the drill string at the surface provides a signal decoding function.

While presently preferred embodiments of the invention have been described herein for the purpose of disclosure, numerous changes in the construction and arrangement of parts and the performance of steps will suggest themselves to those skilled in the art, which changes are encompassed within the spirit of this invention as defined by the following claims.

What is claimed is:

1. Apparatus for rotationally orienting a fluid conducting conduit, the conduit being rotatable about its longitudinal axis; comprising:

an insert, connectable inside the conduit so that the insert is rotatable with the conduit, for restricting fluid flow through the conduit, the insert having an upstream side facing into the fluid flow and a downstream side facing the opposite direction;

a flow passageway,.extending through the insert, for passing fluid through the insert, the flow passageway having an upstream end and a downstream end;

a pilot passageway, extending through the insert, for passing fluid through the insert, the pilot passageway having an upstream end and a downstream end;

a piston bore, located in the insert, having an upstream end open to the flow passageway and a downstream end open to the pilot passageway;

a piston, reciprocably mounted in the piston bore, for reciprocating between the upstream and downstream ends of the piston bore, the piston restricting flow through the flow passageway and creating a fluid pressure increase on the upstream side of the insert when the piston is in a restricted position in the piston bore; and barrier means for blocking the pilot passageway in a selected rotational position of the pilot passageway and conduit in order to increase the fluid pressure at the downstream end of the piston bore and move the piston to the restricted position in the piston bore.

2. The apparatus of claim 1 wherein the downstream end of the pilot passageway is eccentrically positioned with respect to the longitudinal axis of the conduit.

3. The apparatus of claim 1, in which the barrier means comprises:

a shaft, extending axially from the downstream side of the insert; and a barrier mass, rotatably mounted on the shaft, for blocking the second end of the pilot passageway.

4. The apparatus of claim 1 wherein the restricted position of the piston is at the upstream end of the piston bore.

5. The apparatus of claim 4 in which the flow passageway comprises:

a control port extending through the upstream side of the insert;

wherein the control port is open to fluid communication with the flow passageway when the pilot passageway is open and the piston is at the downstream end of the piston bore; and wherein the control port is closed to fluid communication with the flow passageway when the pilot passageway is blocked by the barrier means and the piston is at the upstream end of the piston bore.

6. The apparatus of claim 1, comprising sensing means for sensing fluid pressure changes in the conduit upstream of the insert in order to determine when the pilot passageway and conduit are in the selected rotational position.

7. Apparatus for orienting a collar on a fluid conducting conduit, the collar and conduit being rotatable relative to one another about the longitudinal axis of the conduit, the apparatus comprising:

an orifice through the wall of the conduit; and latch means for latching the collar to the conduit, allowing fluid communication through the orifice, and rotating the collar when the conduit is rotated in a first direction; and for unlatching the collar from the conduit, preventing fluid communication through the orifice, and allowing the conduit to rotate relative to the collar when the conduit is rotated in a second, opposite direction.

8. The apparatus of claim 7, comprising:

a recess in the inside surface of the collar; and wherein the recess and the latch means are radially coincident with respect t the longitudinal axis of the conduit at least once during a rotation of the conduit relative to the collar.

9. The apparatus of claim 8 in which the latch means comprises:

a valve, connected to the orifice, for sealing the orifice when the orifice and the recess are not radially coincident; and biasing means for biasing the valve into latching engagement with the recess when the valve and the recess are radially coincident.

10. The apparatus of claim 9 wherein the fluid communication through the orifice biases the valve into engagement with the recess and purges the orifice and valve.

11. The apparatus of claim 8 in which the orifice comprises:

a first end extending through the inside surface of the conduit wall;

a second end extending through the outside surface of the conduit wall, the second end forming a valve seat; and in which the latch means comprises a latch arm, including:

a first end pivotably connected to the conduit wall adjacent the second end of the orifice, the pivotable axis of the first end being about parallel to the longitudinal axis of the conduit;

a second end extending about perpendicularly to the first end, the second end forming a valve;

wherein the latch arm is pivotable between an open position in which the second end extends outside of the conduit wall and the orifice is open and a closed position in which the second end closes the orifice; and biasing means for biasing the latch arm into the open position.

12. The apparatus of claim 11 wherein the biasing means biases the second end of the latch arm into the open position and into engagement with the recess when the recess and the second end of the orifice are radially coincident;

wherein the second end of the latch arm latches into the recess when the conduit is rotated one direction in order to rotate the collar with the conduit; and wherein the second end of the latch arm is unlatched from the recess and is moved to the closed position by the collar when the conduit is rotated the other direction.

13. The apparatus of claim 7, comprising sensing means for sensing fluid loss through the orifice in order to determine when the collar is latched to the conduit.

14. The apparatus of claim 7, comprising sensing means for sensing fluid pressure changes in the conduit in order to determine when the collar is latched to the conduit.

15. The apparatus of claim 7, comprising:

an insert, connectable inside the conduit so that the insert is rotatable with the conduit, for restricting fluid flow through the conduit, the insert having an upstream side facing into the fluid flow and a downstream side facing the opposite direction;

a flow passageway, extending through the insert, for passing fluid through the insert, the flow passageway having an upstream end and a downstream end;

a pilot passageway, extending through the insert, for passing fluid through the insert, the pilot passageway having an upstream end and a downstream end;

a piston bore, located in the insert, having an upstream end open to the flow passageway and a downstream end open to the pilot passageway;

a piston, reciprocably mounted in the piston bore, for reciprocating between the upstream and downstream ends of the piston bore, the piston restricting flow through the flow passageway and creating a fluid pressure increase on the upstream side of the insert when the piston is in a restricted position in the piston bore; and barrier means for blocking the second end of the pilot passageway in a selected rotational position of the pilot passageway and conduit in order to increase the fluid pressure at the downstream end of the piston bore and move the piston to the restricted position in the piston bore.

16. The apparatus of claim 15 wherein the latch means latches the collar to the conduit in a selected rotational orientation of the collar relative to the pilot passageway.

17. The apparatus of claim 16 wherein the latch means latches the collar to the conduit when a selected point on the collar is diametrically opposite the pilot passageway.

18. A method of rotationally orienting a conduit with respect to the longitudinal axis of the conduit, comprising:

placing an insert containing a reciprocable piston in the conduit so that the insert will rotate with the conduit;

flowing pressurized fluid through the conduit and insert, the fluid flowing from the upstream side of the insert to the downstream side of the insert;

creating a fluid pressure increase inside the insert in a selected rotational orientation of the insert and conduit;

using the fluid pressure increase inside the insert to shift the piston to a restricted position when the conduit and insert are in the selected rotational orientation;

rotating the conduit about the longitudinal axis of the conduit; and sensing the shift of the piston to the restricted position to determine the rotational orientation of the conduit.

19. The method of claim 18, wherein:

the piston restricts fluid flow through the conduit and insert when the piston is in the restricted position and increases the fluid pressure in the conduit on the upstream side of the insert; and in which the sensing step comprises:

sensing fluid pressure in the conduit on the upstream side of the insert in order to determine the rotational orientation of the conduit.

20. The method of claim 18, in which the creating a fluid pressure increase step comprises restricting fluid flow through the insert with a gravitationally positioned barrier mass on the downstream side of the insert.

21. A method of rotationally orienting a collar on a conduit with respect to the longitudinal axis of the conduit, comprising:

providing an orifice through the wall of the conduit; flowing pressurized fluid through the conduit and orifice, and rotating the collar with the conduit when the conduit is rotated in a first direction about the longitudinal axis of the conduit; and preventing fluid flow through the orifice and allowing the conduit to rotate relative to the collar when the conduit is rotated in a second, opposite direction about the longitudinal axis of the conduit.

22. The method of claim 21 in which the passing fluid step comprises latching the collar to the conduit and passing fluid through the orifice in a selected rotational orientation of the collar with respect to the conduit.

23. The method of claim 22, comprising sensing fluid loss through the orifice to determine when the collar is rotating with the conduit.

24. The method of claim 22, comprising sensing fluid pressure loss in the conduit upstream of the orifice to determine when the collar is rotating with the conduit.

25. The method of claim 22, comprising:

placing an insert containing a reciprocable piston in the conduit so that the insert rotates with the conduit;

flowing the pressurized fluid through the conduit and insert, the fluid flowing from the upstream side of the insert to the downstream side of the insert;

creating a fluid pressure increase inside the insert in a selected rotational orientation of the insert and conduit relative to a selected rotational orientation of the collar;

using the fluid pressure increase inside the insert to shift the piston to a restricted position when the conduit and insert are in the selected rotational orientation relative to the collar;

rotating the conduit about the longitudinal axis of the conduit in the first direction; and sensing the shift of the piston to the restricted position to determine the rotational orientation of the conduit and the rotational orientation of the collar.

26. A method of rotationally orienting a collar on a conduit with respect to the longitudinal axis of the conduit, comprising:

flowing pressurized fluid through the conduit;

rotating the conduit in a first direction about the longitudinal axis of the conduit to rotate the collar;

providing a collar signal when the collar is rotating with the conduit in a selected rotational orientation of the collar with respect to the conduit; and sensing the collar signal to determine when the collar is rotating with the conduit.

27. The method of claim 26 in which the providing a collar signal step comprises changing the fluid pressure in the conduit.

28. The method of claim 26 in which the providing a collar signal step comprises decreasing the fluid pressure in the conduit; and in which the sensing step comprises sensing the fluid pressure decrease.

29. The method of claim 28 in which the decreasing step comprises:

providing an orifice through the wall of the conduit; and flowing the pressurized fluid through the orifice when the collar is rotated with the conduit.

30. The method of claim 26, comprising:

providing an orientation signal when the conduit is in a selected rotational orientation; and sensing the orientation signal to determine when the conduit is in the selected rotational orientation.

31. The method of claim 30, comprising:

continuing to rotate the conduit in the first direction after sensing the collar signal; and sensing the orientation signal to determine when the conduit is in the selected rotational orientation and the collar is in the selected rotational orientation with respect to the conduit.

32. The method of claim 30 in which the providing an orientation signal step comprises changing the fluid pressure in the conduit.

33. The method of claim 30 in which the providing an orientation signal step comprises increasing the fluid pressure in the conduit; and in which the sensing step comprises sensing the fluid pressure increase.

34. A method of rotationally orienting a collar on a conduit with respect to the longitudinal axis of the conduit, comprising:

flowing pressurized fluid through the conduit;

rotating the conduit in a first direction about the longitudinal axis of the conduit to rotate the collar;

decreasing the fluid pressure in the conduit when the collar is rotating with the conduit in a selected rotational orientation of the collar with respect to the conduit;

sensing the fluid pressure decrease to determine when the collar is rotating with the conduit;

creating a fluid pressure increase when the conduit is in a selected rotational orientation;

sensing the fluid pressure increase to determine when the conduit is in the selected orientation and the collar is in the selected rotational orientation; and rotating the conduit in a second direction, opposite to the first direction, to rotate the conduit relative to the collar and leave the collar in the selected rotational orientation.

* * * * *